United States Patent [19]

Sorenson

[11] Patent Number: 4,680,435

[45] Date of Patent: Jul. 14, 1987

[54] ROCKER SWITCH FOR SLIDING OR PIVOTING CONTACT LEVER

[75] Inventor: Richard W. Sorenson, Avon, Conn.

[73] Assignee: Carlingswitch, Inc., West Hartford, Conn.

[21] Appl. No.: 838,915

[22] Filed: Mar. 11, 1986

[51] Int. Cl.[4] ..... H01H 5/06; H01H 21/42; H01H 1/06

[52] U.S. Cl. ..... 200/68.2; 200/275; 200/339; 200/67 PK

[58] Field of Search ..... 200/67 PK, 68.1, 68.2, 200/68.3, 339, 329, 275, 281

[56] References Cited

U.S. PATENT DOCUMENTS

| | | | |
|---|---|---|---|
| 1,838,239 | 12/1931 | Tucker | 200/67 PK |
| 2,780,691 | 2/1957 | Landin | 200/68.2 X |
| 3,316,370 | 4/1967 | Ardizzi | 200/68.2 X |
| 4,347,417 | 8/1982 | Sorenson | 200/68.3 |
| 4,408,106 | 10/1983 | Sorenson | 200/68.3 |
| 4,430,534 | 2/1984 | Sorenson | 200/68.3 |
| 4,524,253 | 6/1985 | Sorenson | 200/68.2 |

FOREIGN PATENT DOCUMENTS

| | | | |
|---|---|---|---|
| 551221 | 2/1943 | United Kingdom | 200/67 PK |
| 568106 | 3/1945 | United Kingdom | 200/67 PK |

*Primary Examiner*—Stephen Marcus
*Assistant Examiner*—Ernest G. Cusick
*Attorney, Agent, or Firm*—McCormick, Paulding & Huber

[57] ABSTRACT

A common switch base and rocker are combined with either a sliding contact or with a pivoting contact lever to provide two different types of electrical switches from fewer different component parts. The rocker has a depending post portion for sliding the smaller contact, and the longer contact lever has an elongated slot to accommodate the rocker post portion without interfering with it. The rocker also has internal abutments that engage the contact lever to assure positive action thereof, which abutments do not interfere with action of the sliding contact.

4 Claims, 5 Drawing Figures

ROCKER SWITCH FOR SLIDING OR PIVOTING CONTACT LEVER

SUMMARY OF INVENTION

This invention relates generally to electrical switches of different basic internal mechanisms, yet having a single configuration for the switch case or base and the associated rocker or actuator pivotally provided in the case. More particularly, this invention deals with a unique configuration for the contact lever in a butt contact switch wherein the lever is pivotably supported on a central fixed contact, and wherein the basic internal configuration for the switch can be alternatively provided by replacing the contact lever with a sliding movable contact of the type shown generally in issued U.S. Pat. No. 4,347,417.

The general purpose of the present invention is provide a unique switch construction having a minimum number of component parts, which switch construction permits the identical switch case and rocker components to be used either in a butt type contact switch or in a switch wherein the movable contact slides across the upper end of the center fixed contact in a combination of pivotal and sliding motion.

In a typical prior art switch of the type having a movable contact element slidably received in the switch case cavity a rocker is pivotably supported in the upper portion of the switch case cavity and has a depending portion extending downwardly toward a center fixed contact in order to achieve sliding motion of the movable contact in response to pivotal motion of the rocker. A spring is preferably provided on this depending portion and acts between the rocker and an upper raised portion of the movable contact. In accordance with the present invention the above-identified switch construction is modified to the extent that the slidably movable contact is replaced by a contact lever of somewhat longer geometry such that it is adapted to be pivotably supported on the center fixed contact and to have butt contacts on one or both ends for engaging at least one fixed butt contact within the switch case cavity. The depending portion of the rocker is adapted to move freely without disturbing this pivotably mounted contact lever, and the lever has a generally U-shaped cross section with upwardly projecting side wall portions that cooperate with one another to define a seating surface for the lower end of the spring. The spring acts on the contact lever to bias the lever toward one or the other of two limit positions defining two different switch conditions. The novelty of the present invention resides in the geometry for the movable contact lever itself whereby the lever can be provided in a switch of otherwise conventional geometry including the conventional geometry for the rocker as utilized in a typical switch having a slidable contact element as shown and described in the above-identified prior art U.S. Pat. No. 4,347,417.

DETAILED DESCRIPTION OF PREFERRED EMBODIMENT

Figure 1:
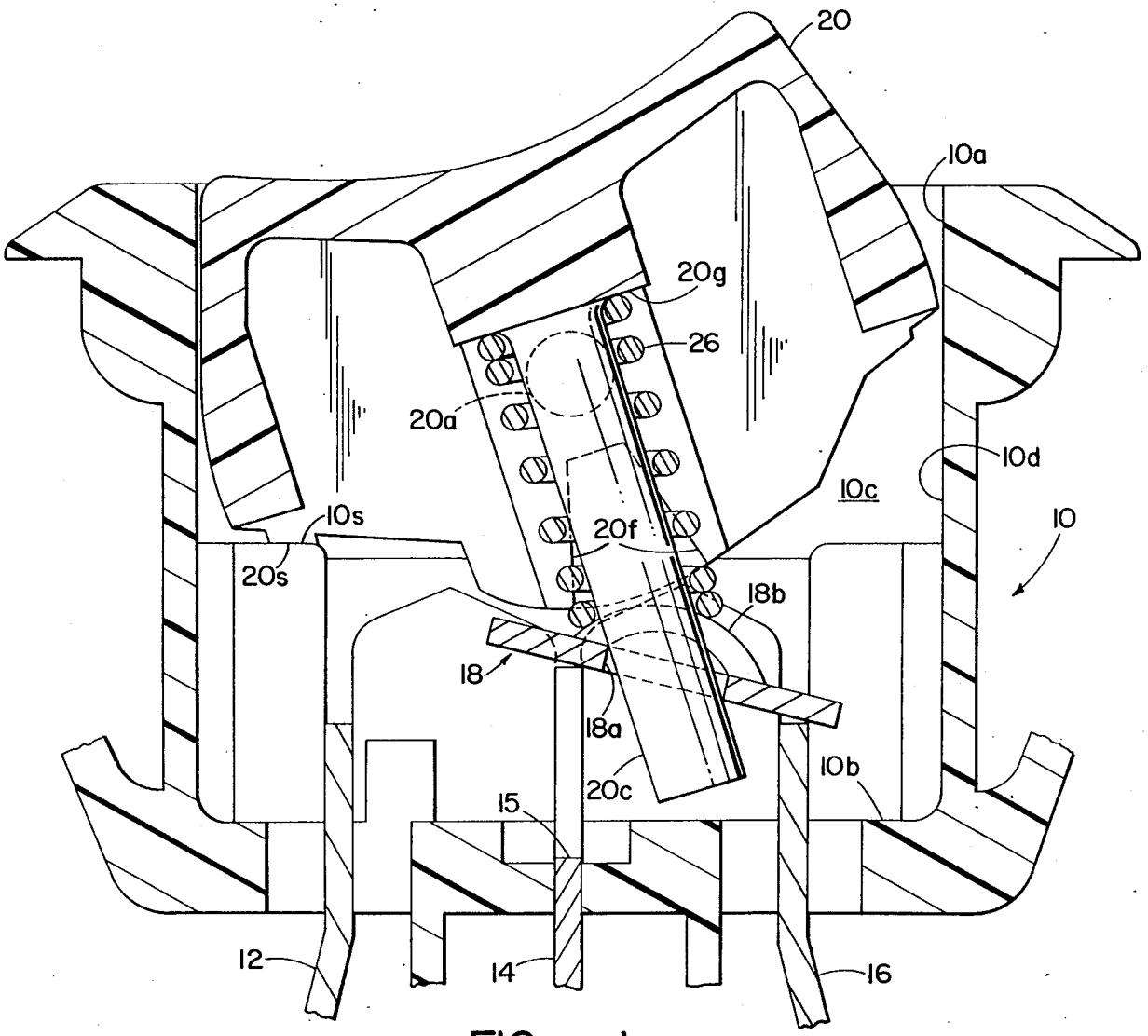
FIG. 1 shows a switch constructed in accordance with the teaching of prior art U.S. Pat. No. 4,347,417 except for the provision of abutments inside the rocker to act on a movable contact lever other than that shown in this view.

Turning now to the drawings in greater detail, FIG. 1 shows a preferred embodiment for the switch as shown in prior art U.S. Pat. No. 4,347,417, but with certain changes made to the configuration of the rocker itself such that the rocker will serve not only to operate the sliding contact of FIG. 1 but also the pivoting contact lever of FIGS. 2, 3 and 4.

The switch of FIG. 1 includes a switch base or case comprising a one-piece molded plastic part 10 having an upwardly open cavity 10*a*, which cavity is defined in part by a bottom wall 10*b* and integrally connected side and end walls 10*c* and 10*d*. The bottom wall is provided with at least two fixed contacts and in the version shown three such fixed contacts 12, 14 and 16 are illustrated. One fixed contact 14 is provided centrally of the rectangular switch base and two identical fixed contacts 12 and 16 are provided on either side of the center contact in the switch version shown. Only one 16 of these two fixed contacts 12 and 16 would be required in an on/off switch. A movable contact element 18 is slidably received on the upper edge of center fixed contact 14 for movement between the position shown and an opposite limit position (not shown) as described in some detail in said prior art U.S. Pat. No. 4,347,417. As shown, the sliding contact 18 bridges the center fixed contact 14 and the slightly lower upper edge of fixed contact 16 to provide a stable switch position or condition.

Figure 4:
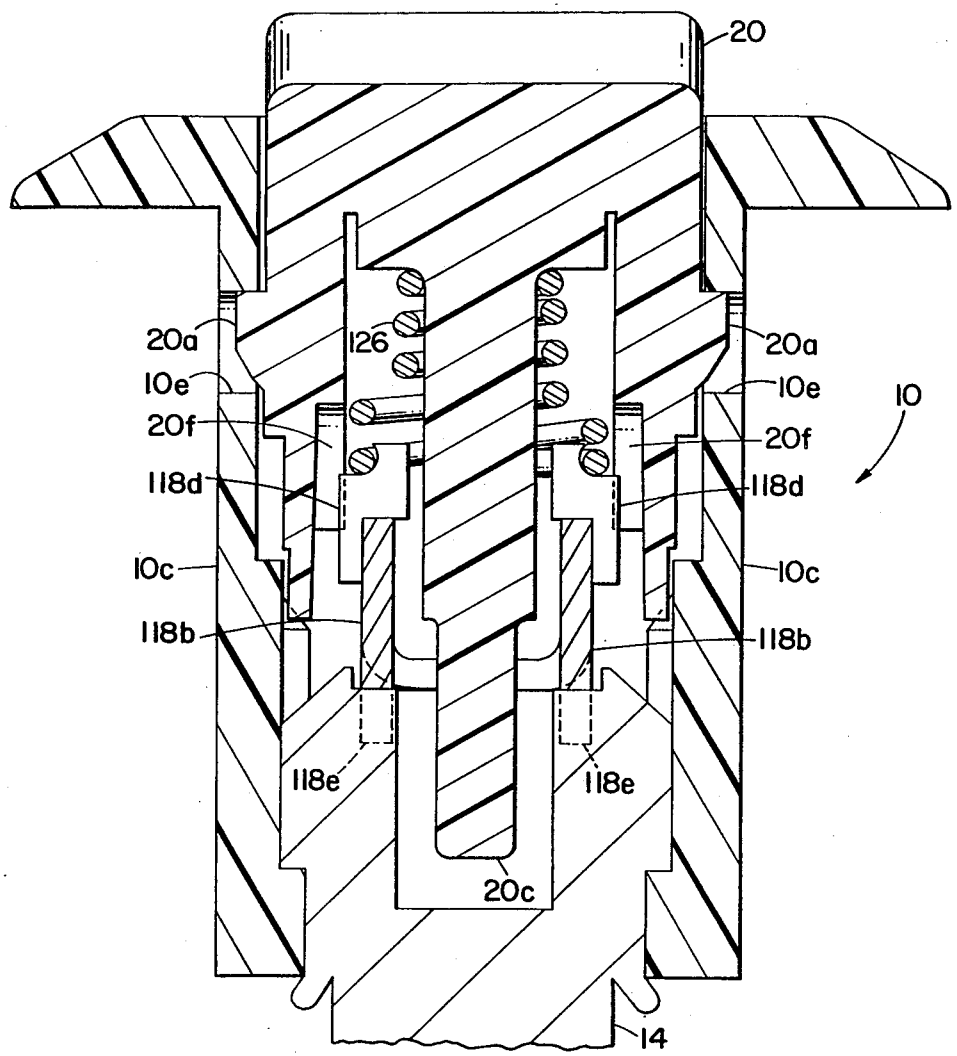
FIG. 4 is a sectional view taken generally on the line 4—4 of FIG. 3.

The movable or sliding contact 18 is adapted to be shifted from the position shown to its opposite limit position by movement of a rocker actuator 20 and more particularly by reason of depending portion 20*c* of the actuator moving from the position shown to an opposite or mirror image position. The center fixed contact 14 is slotted to provide clearance for the depending portion 20*c* as indicated generally by the bottom of the slot 15 in this fixed contact 14 all as described in the above mentioned patent. A coil compression spring 26 acts between a land 20*g* provided for this purpose in the rocker 20 and the lower end of the spring 26 engages lands 18*b* provided for this purpose on the movable contact 18. Rocker actuator 20 is pivotably provided in the switch case cavity for movement between the position shown and an opposite limit position that is the mirror image of the position shown. The axis of movement for the rocker 20 is defined by projecting portions 20*a* that are received in aligned openings 10*e*, 10*e* provided for this purpose in the switch case side walls 10*c*. FIG. 4 illustrates this mounting for the rocker 20 in another version of switch to be described below.

As so constructed and arranged it will be apparent that the sliding contact switch of FIG. 1 has switch case 10, a rocker 20 pivotably provided in its upper region and the rocker has a depending portion 20*c* received in an opening 18*a* in the sliding contact 18 so that sliding movement of the contact 18 is achieved as a result of pivotal action imparted to the rocker 20. The spring 26 acts between the rocker 20 and lands 18*a* defined for this purpose on the sliding contact 18 so as to achieve stable limit positions for the contact 18 and so as to provide stable limit positions for the rocker 20 itself.

Figure 2:
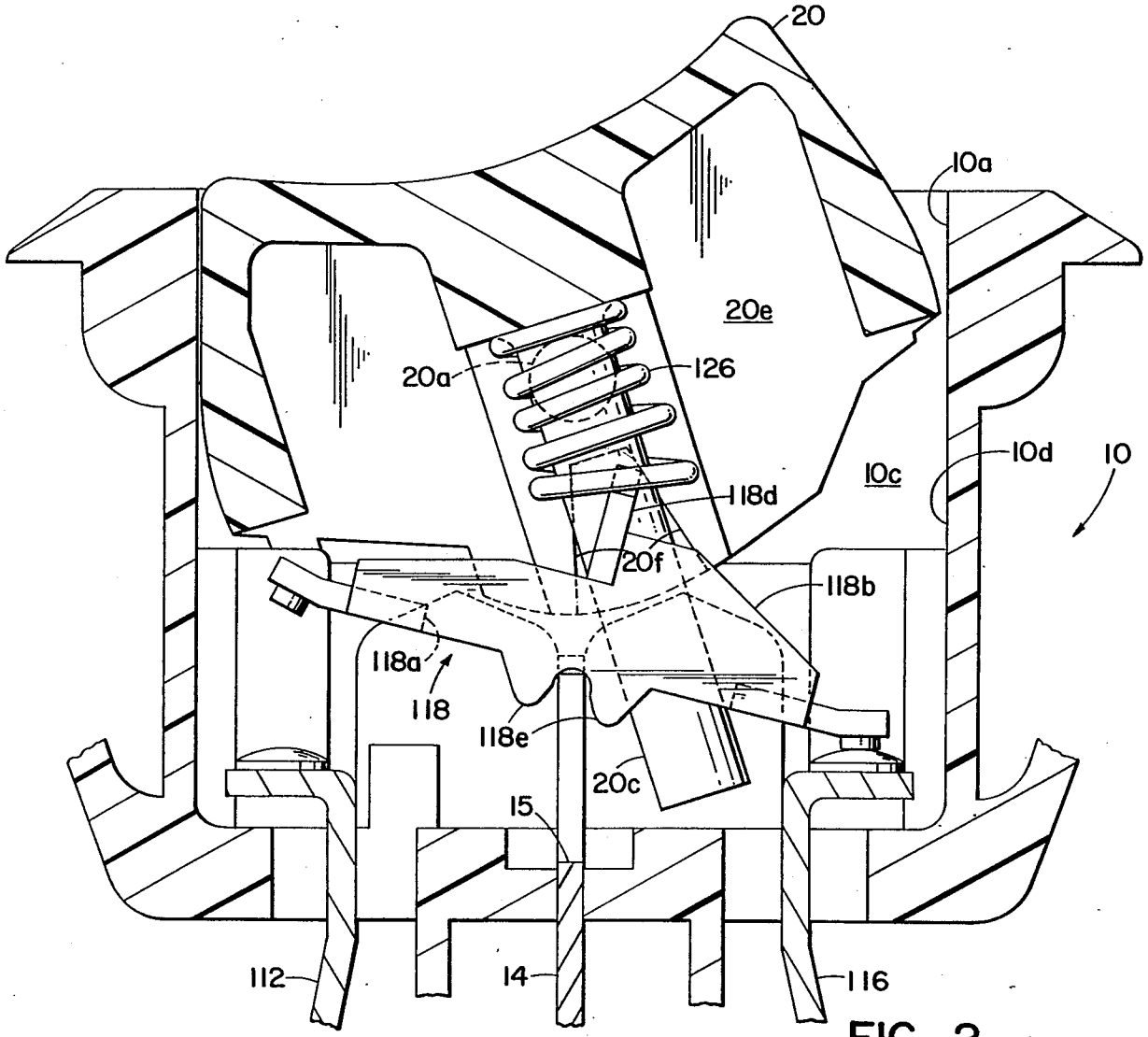
FIG. 2 shows a switch with the same case and rocker as illustrated in FIG. 1, but with a unique contact lever provided in place of the sliding contact element shown in FIG. 1, and with a slightly different spring configuration and fixed contact configuration as well.

FIG. 2 shows an alternative switch construction utilizing the same switch case 10 and rocker 20 but with a different movable contact 118 pivotably provided on the upper end of fixed contact 14. The FIG. 2 switch is especially well suited to achieve a butt contact action between at least one end of this contact lever 118 and at least one fixed contact of the type illustated generally at 112. The chief aim of the present invention is to provide the same rocker 20 in the switch of FIG. 2 as utilized in the switch of FIG. 1, that is with depending portion 20*c* extending downwardly through the contact lever itself but without interferring or otherwise adversely effecting the pivoting action of the contact lever 118. That is, without sliding movement of the lever 118, and yet with the requisite pivotal movement for achieving the butt contact between lever 118 and fixed butt contacts 112 and 116.

Figure 5:
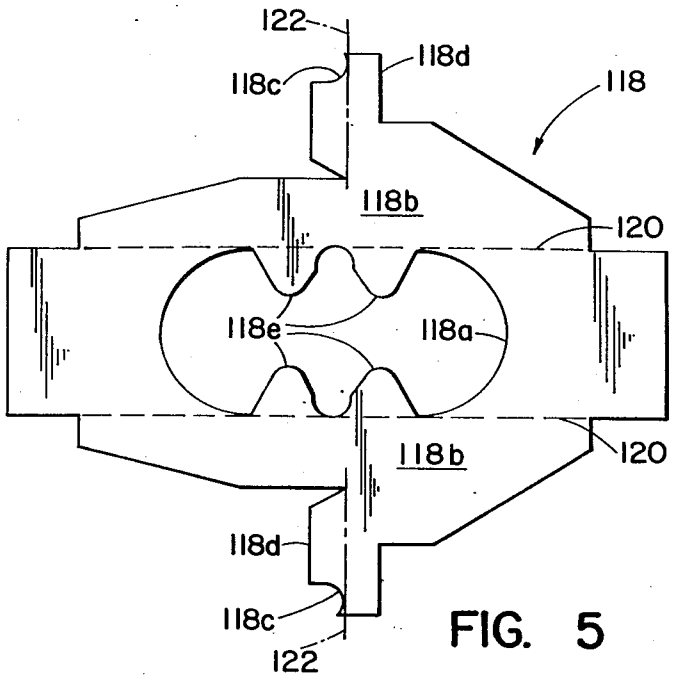
FIG. 5 is a plan view of the contact lever illustrated in FIGS. 2–4, but shows the lever prior to its finally formed bent configuration.

The contact lever 118 is formed from an initially flat plate as indicated generally at 118 in FIG. 5, which plate 118 is stamped to provide the opening indicated generally at 118*a* centrally thereof and with an external configuration as shown. The plate is then formed into a generally U-shape with upwardly projecting side portions as indicated generally at 118*b*, these side portions being bent along the lines indicated generally at 120 in FIG. 5. Projecting tabs 118*d* in these side wall portions are twisted on lines indicated generally at 122 in FIG. 5 to form the upwardly and outwardly projecting ears 118*d*, 118*d* which ears serve two functions to be described in greater detail with reference to FIG. 4. One of these functions is to define raised lands 118*c* for receiving the lower end of spring 126 in FIG. 2. This spring 126 acts between the rocker 20 and these lands 118*c* defined on ears 118*d* to urge the contact lever toward one of its two limit positions and thereby maintain contact between fixed contact 114 and contact lever 118 in the FIG. 2 position shown.

The contact lever 118, and more particularly the central opening 118*a* formed therein, is not a slot of uniform width, but this slot opening 118*a* includes portions 118*e* that define a saddle for the contact lever 118. As so constructed the lever 118 is restricted to pivotal motion only relative to the upper fulcrum defining edge of the center fixed contact 14. As can be seen from FIG. 4 these portions 118*e* are disposed in the same plane as that defined by the side portions 118*b*.

Figure 3:
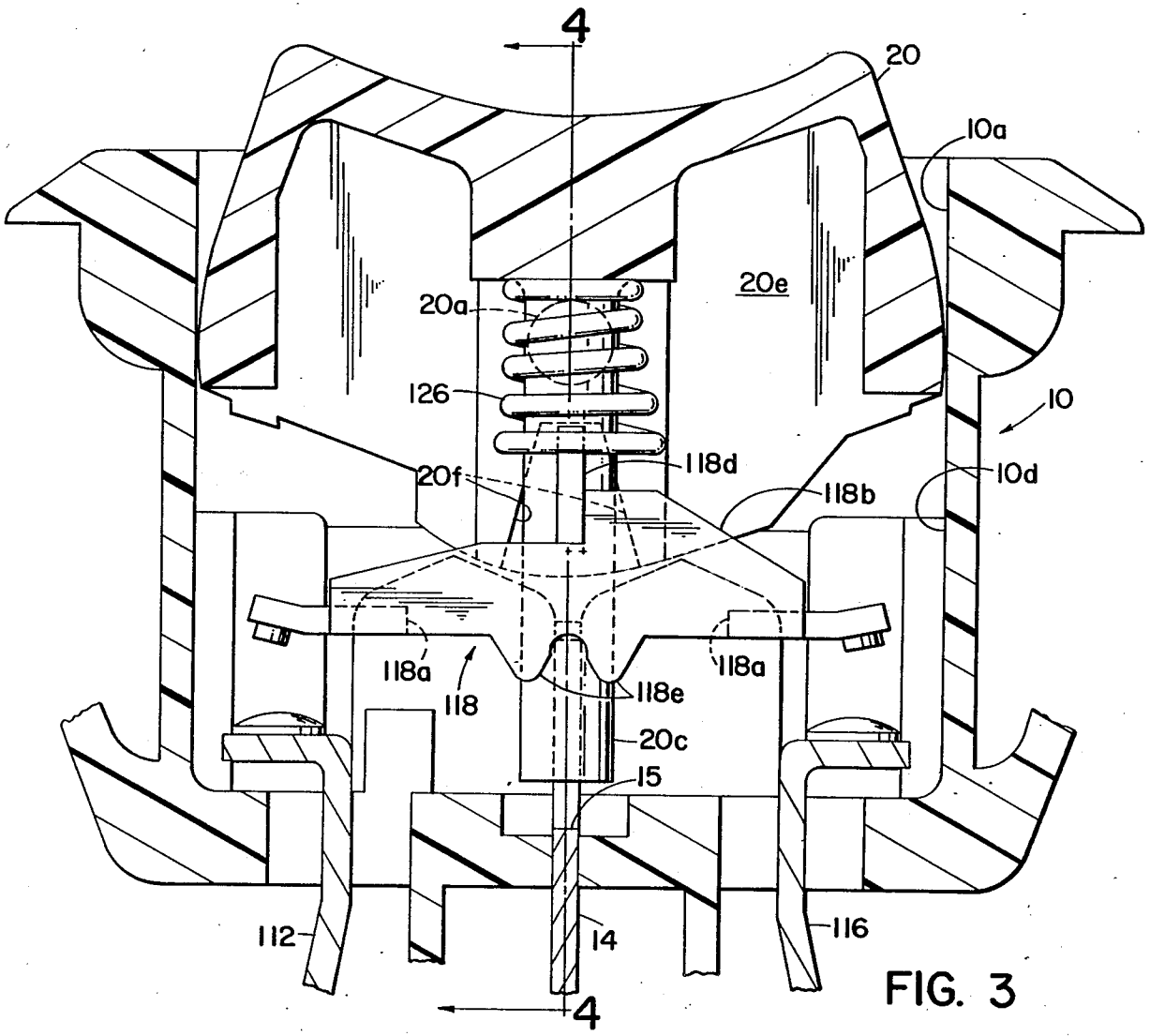
FIG. 3 is a view of the same switch illusrated in FIG. 2 but showing the rocker and contact lever in a position intermediate the opposed limit positions, one of which limit positions is shown in FIG. 2.

As so constructed and arranged the rocker 20, acting through the biasing means of spring 126, serves to move contact lever 118 between the limit position shown in FIG. 2 through an intermediate position as shown in FIG. 3, to a position that is the mirror image of that of FIG. 2. This provides alternate butt contact between the ends of contact lever 118 and the fixed butt contacts 112 and 116. The lower depending portion 20*c* of the rocker extends through elongated opening 118*a* provided for this purpose in the contact lever 118 and this without any translation or sliding motion of the contact lever 118. The raised lands 118*c* defined by the ears 118*d* on the contact lever 118 are engaged by the lower end of spring 126 and help in achieving this motion of the contact lever 118 and to hold both the lever and the rocker in their limit positions. In order to provide a more positive action for the lever 118 as a result of the rocking motion for the rocker actuator 20 I prefer to provide abutments on the inside facing side walls 20*e* of the rocker which abutments are indicated generally at 20*f* in the drawings. These abutments interact with the laterally outwardly projecting ears 118*d* on the contact lever 118 so as to insure that rocking movement of the rocker actuator 20 will cause pivotal motion of the contact lever 118 and avoid any tendency for the contact lever 118 to "hang up" in a mid-position such as is illustrated in FIG. 3 for example. As will be apparent from FIG. 3 any movement of the rocker 20 from the intermediate position shown will cause these abutments 20*f*, or one of them to move the contact lever 118 one way or the other urging the lever 118 towards one of its two limit positions. This FIG. 3 position for the rocker and contact lever is therefor an unstable one in that the rocker 20 will be urged in a clockwise rotational direction so as to cause counter-clockwise movement of the lever 118 as a result of the action of the spring 126 on the raised lands 118*c*. The fact that these lands 118*c* are raised well above the fulcrum for the contact lever causes the lever and rocker to move in these directions. The above described abutments 20*f* serve to reinforce this tendency of the spring 126 to urge the contact lever 118 in one direction or the other. As shown in FIG. 3 the abutment 20*f* defined by the rocker 20 and more particularly by the side wall 20*e* on each lateral side of the rocker 20 comprises a downwardly open channel defined by inwardly projecting portions of the rocker 20. These abutments 20*f* are preferably formed in all rockers whether these rockers are to be used in a slide type switch of the type shown in FIG. 1, or in a butt contact lever type electrical switch of the type illustrated in FIGS. 2–4 inclusively. Such a geometry for rocker 20 permits the same part to be used in either type switch. So too the case 10 can be used in both types of switch, as can the center fixed contact 14. The other fixed contacts 112 and 116 are of different upper configuration but can be seen to fit into the same slots in the case bottom wall as contacts 12 and 16 in FIG. 1.

I claim:

1. A switch comprising a base of insulating plastic and defining an upwardly open cavity, at least two fixed contacts spaced along the bottom wall of said base cavity, one of said fixed contacts having an upper edge defining a contact lever fulcrum and the other fixed contact defining an upwardly facing butt contact, a rocker actuator pivotably supported in said switch base for movement on a pivot axis defined in said base and located above said fulcrum, said actuator having a depending portion, a lower end of said depending portion extending downwardly below said fulcrum, said actuator having laterally spaced wall portions, a coil spring provided on said depending portion generally between said actuator wall portions, said spring having an upper end engaging a rocker defined land downwardly facing, a movable contact lever having a central saddle portion provided on said fixed contact fulcrum for pivotal movement of said lever between first and second limit positions, said contact lever having a butt contact spaced from said saddle portion for engaging selectively said fixed butt contact in a first limit position of said contact lever, said lever having a U-shaped cross section with an opening in the base of the U to provide clearance for said depending actuator portion, said U-shape contact lever further including laterally spaced wall portions, upper edges of said contact lever wall portions defining laterally spaced lands for engaging a lower end of said coil spring, said wall portions of said contact lever provided between said actuator wall portions, and means provided in part on said actuator wall portions and in part on said contact lever wall portions for achieving positive movement of said lever in response to movement of said rocker actuator.

2. The switch of claim 1 wherein said contact lever opening providing clearance for said depending actuator portion has a longitudinal extent such that the depending actuator portion does not contact the lever through the full range of pivotal motion of the lever between its first and second positions and through the full range of movement of the rocker between its limit positions, said rocker being limited in its motion as a result of stop surfaces provided in part on said switch case and in part on said rocker actuator.

3. In combination, a switch case of insulating plastic having an upwardly open cavity defined by integrally connected side, end and bottom walls, a rocker actuator having projections received in aligned openings defined in the switch case side walls and movable on a fixed pivot axis in the switch case between opposed limit positions defined by abutting surfaces in the switch case and on the actuator, fixed contacts in the switch case bottom wall, an upper edge of one said fixed contact defining a fulcrum located below said rocker pivot axis, said rocker having a depending portion with its lower end movable through an upwardly open slot in said one fixed contact such that said depending portion extends below said fixed fulcrum, a sliding contact slidably received on said upper edge of said one fixed contact and having an opening for receiving said lower end of said depending rocker portion to achieve sliding motion of the sliding contact as a result of pivoting rocker movement, a coil spring on said depending portion for urging said sliding contact downwardly, said spring also acting on said sliding contact to bias said contact toward at least one of its two limit positions wherein the sliding contact bridges said one contact and another of said fixed contacts spaced from said one fixed contact, and a contact lever for replacing said sliding contact said lever having a lower saddle for pivotably supporting said contact lever on the upper edge of said one fixed contact without sliding motion, said lever having a U-shaped cross section with upwardly extending side portions and a base portion defining at least one contact bridging arm portion for abutting another of said fixed contacts in at least one of two limit positions for said contact lever, said spring acting on said upwardly extending side portions to bias said contact lever to one of at least two limit positions, said sliding contact and said contact lever being selectively provided on said one fixed contact for movement respectively in response to pivotal motion of the rocker actuator.

4. The combination of claim 3 wherein said rocker has depending side wall portions adjacent the side walls of the switch case, and wherein said U-shaped contact lever has laterally outwardly projecting ears adjacent the upper edges of these side portions to interact with abutments defined for this purpose on the inwardly facing side walls of the rocker to achieve positive action of the contact lever in response to pivotal motion of the rocker.

* * * * *